US005276248A

United States Patent [19]

Engelhardt et al.

[11] Patent Number: 5,276,248

[45] Date of Patent: Jan. 4, 1994

[54] PROCESS FOR THE STORAGE AND TRANSPORTATION OF LIQUID HYDROCARBONS

[75] Inventors: Fritz Engelhardt, Frankfurt am Main; Gerlinde Ebert, Dreieich/Offenthal; Heinz Hoffmann, Bayreuth; Gerhard Platz, Neunkirchen/Weidenberg; Werner Ritschel, deceased, late of Königstein im Taunus, all of Fed. Rep. of Germany, by Maria A. Ritschel, sole heiress

[73] Assignee: Cassella Aktiengesellschaft, Frankfurt, Fed. Rep. of Germany

[21] Appl. No.: 938,996

[22] Filed: Sep. 2, 1992

[30] Foreign Application Priority Data

Sep. 9, 1991 [DE] Fed. Rep. of Germany ..... 4129943

[51] Int. Cl.[5] ..... C07C 7/20

[52] U.S. Cl. ..... 585/899; 585/2; 585/3; 585/15; 585/833; 137/3; 137/4; 137/13

[58] Field of Search ..... 585/2, 3, 15, 833, 899; 137/3, 4, 13

[56] References Cited

U.S. PATENT DOCUMENTS

| | | | |
|---|---|---|---|
| 2,890,257 | 6/1959 | Ayers et al. | 585/899 |
| 3,378,418 | 4/1968 | Lissant | 149/109 |
| 3,416,320 | 12/1968 | Asher | 60/208 |

OTHER PUBLICATIONS

Database WPI, Section Ch, Week 7636, Derwent Publications Ltd., Abstract of JP-A-50 051 506, Class E 10, AN 76-67497X.

*Primary Examiner*—Anthony McFarlane
*Assistant Examiner*—Nhat D. Phan
*Attorney, Agent, or Firm*—Connolly and Hutz

[57] ABSTRACT

The present invention relates to the use of hydrocarbon-rich gels as a safe storage or transportation form for liquid hydrocarbons and to a process for the safe storage and safe transportion of liquid hydrocarbons, characterised in that a) the hydrocarbon is converted into a hydrocarbon-rich gel by addition of a surfactant and water and b) after storage or transportation has taken place, the hydrocarbon-rich gel is broken down again.

20 Claims, No Drawings

PROCESS FOR THE STORAGE AND TRANSPORTATION OF LIQUID HYDROCARBONS

The present invention relates to the use of hydrocarbon-rich gels as a safe storage and transportation form for liquid hydrocarbons and to a process for the safe storage and the safe transportation of liquid hydrocarbons, the hydrocarbon being converted into a hydrocarbon-rich gel which is broken down again after storage or transportation.

BACKGROUND OF THE INVENTION

The storage and transportion of liquid hydrocarbons, for example fuels, via roads, rail and on the waterways present a considerable potential hazard. Thus, for example, the high flammability and explosiveness in mixtures of air has led in the past to serious accidents which have caused considerable damage. Serious ecological damage moreover constantly results from fuels discharged from leaking storage or transportation tanks.

The object of the present invention is therefore to provide a process for the safe storage and the safe transportation of hydrocarbons.

This object is achieved, surprisingly, by storing and transporting the hydrocarbons in the form of hydrocarbon-rich gels.

A hydrocarbon-rich gel is understood as meaning a system which consists of polyhedrons which are formed from surfactant and are filled with hydrocarbon, water forming a continuous phase in the narrow interstices between the polyhedrons. Systems of this type are known and are described in Angew. Chem. 100 933 (1988) and Ber. Bunsenges. Phys. Chem. 92 1158 (1988).

Hydrocarbon-rich gels are distinguished by the occurrence of a flow limit. This flow limit is reached when the gel no longer withstands a stress imposed on it (shear, deformation) and starts to flow. Below the flow limit, the gel structures have the properties of solids and obey Hooke's law. Above the flow limit, in the ideal case, the system is equivalent to a Newtonian fluid. This means that although hydrocarbon-rich gels can be pumped in a simple manner, they cannot flow in the state of rest because of their properties of solids. They therefore cannot be discharged from defective storage or transportation tanks, and danger to the environment is virtually excluded.

SUMMARY OF THE INVENTION

The present invention thus relates to the use of hydrocarbon-rich gels as a safe storage and transportation form for liquid hydrocarbons.

The present invention furthermore relates to a process for the safe storage and the safe transportation of liquid hydrocarbons, characterised in that a) the hydrocarbon is converted into a hydrocarbon-rich gel by addition of a surfactant and water and
b) after storage or transportation has taken place, the hydrocarbon-rich gel is broken down again.

DESCRIPTION OF THE PREFERRED EMBODIMENTS

The present invention relates to a process for safe storage and the safe transportation of liquid hydrocarbons, characterized in that a) the hydrocarbon is converted into a hydrocarbon-rich gel by addition of a surfactant and water and b) after storage or transportation has taken place, the hydrocarbon-rich gel is broken down again.

The surfactant and water are preferably added to the hydrocarbon in amounts such that a hydrocarbon-rich gel of 70 to 99.5% by weight of hydrocarbon, 0.01 to 15% by weight of surfactant and 0.49 to 15% by weight of water is formed.

The surfactant and water are particularly preferably added to the hydrocarbon in amounts such that a hydrocarbon-rich gel of 80 to 99.5% by weight of hydrocarbon, 0.01 to 5% by weight of surfactant and 0.49 to 15% by weight of water is formed.

Hydrocarbons which are particularly suitable for the process according to the invention are n-pentene, n-hexane, n-heptane, n-octane, n-nonane, n-decane, n-dodecane, n-tetradecane, n-hexadecane, cyclohexane, cyclooctane, benzene, toluene, kerosene, petrol, lead-free petrol, heating oil, diesel oil and crude oil.

Anionic, cationic, amphoteric or non-ionic surfactants can be employed to form the hydrocarbon-rich gels.

Preferred anionic surfactants are soaps of the formula $R—CH_2—COO^{\ominus}Na^{\oplus}$ wherein R denotes a hydrocarbon radical having 10 to 20 C atoms;

alkanesulphonates of the formula

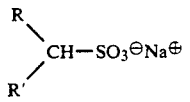

wherein R and R' denote alkyl radicals having together 11 to 17 C atoms;

alkylbenzenesulphonates and -sulfates of the formula

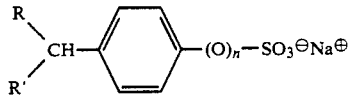

wherein n is 0 or 1 and R and R' denote alkyl radicals having together 11 to 13 C atoms;

olefinesulphonates of the formula $R—CH_2—CH=CH—CH_2—SO_3^{\ominus}Na^{\oplus}$ wherein R denotes alkyl having 10 to 14 C atoms;

fatty alcohol sulphates of the formula $R—CH_2—O—SO_3^{\ominus}Y^{\oplus}$ wherein R denotes alkyl having 11 to 15 C atoms and $Y^{\oplus}$ denotes $Na^{\oplus}$ or triethanolamine;

fatty alcohol polyglycol sulphates of the formula $$R—CH_2—O(C_2H_4O)_n—SO_3^{\ominus}Na^{\oplus}$$

wherein n is 2 to 7 and

R denotes alkyl having 8 to 15 C atoms;

sulphosuccinates of the formula $$R—CH_2—O(C_2H_4O)_n—\overset{\overset{\displaystyle O}{\|}}{C}—\underset{\underset{\displaystyle SO_3^{\ominus}Na^{\oplus}}{|}}{CH}—CH_2COO^{\ominus}Na^{\oplus}$$

wherein n is 2 to 6 and

R denotes alkyl having 11 to 13 C atoms;

fatty alcohol polyglycol phosphates of the formula $$R-CH_2-O(C_2H_4O)_nPO_3H^{\ominus}Na^{\oplus}$$

wherein n is 2 to 6 and

R denotes alkyl having 15 to 17 C atoms;

alkanephosphonates of the formula $$R-PO_3H^{\ominus}Na^{\oplus}$$

wherein R denotes alkyl having 12 to 16 C atoms;

and sodium salts of oleic acid derivatives, such as oleic acid sarcoside, oleic acid isothionate or oleic acid methyl-tauride.

Preferred cationic surfactants are quaternary ammonium compounds of the formula

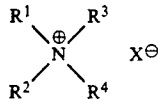

wherein $R^1$ denotes alkyl having 10 to 22 C atoms, $R^2$ denotes alkyl having 1 to 12 C atoms or benzyl, $R^3$ and $R^4$ independently of one another denote hydrogen or methyl and $X^{\ominus}$ denotes $Cl^{\ominus}$, $Br^{\ominus}$ or $CH_3SO_4^{\ominus}$;

fatty amines, such as, for example, coconut-fatty amines, lauryl-fatty amine, oleyl-fatty amine, stearyl-fatty amine, tallow-fatty amine, dimethyl-fatty amines or primary alkylamines having pure chains of 8 to 22 C atoms;

ammonium borate betaine based on didecylamine;

stearyl-N-acylamido-N-methyl-imidazolinium chlorides of the formula

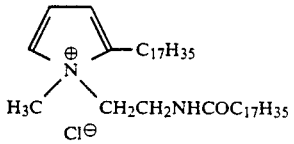

and alkenylsuccinic acid derivatives of the formulae

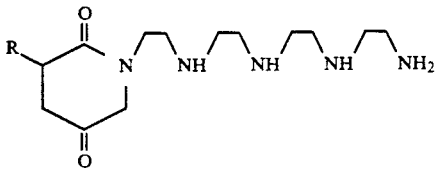

or

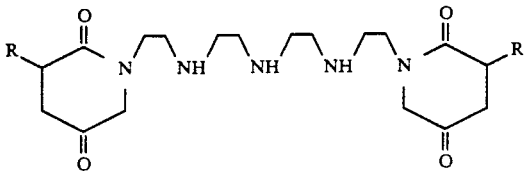

wherein R in each case denotes iso-$C_{18}H_{35}$ or polybutenyl.

Preferred amphoteric surfactants are, for example, alkylbetaines of the formula

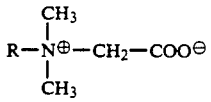

wherein R denotes alkyl having 12 to 14 C atoms;

N-carboxyethyl-N-alkylamido-ethylglycinates of the formula

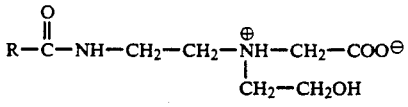

wherein R denotes alkyl having 11 to 13 C atoms; and

N-alkylamido-propyl-N-dimethylamine oxides of the formula

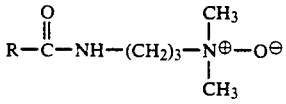

wherein R denotes alkyl having 11 to 13 C atoms.

Preferred non-ionic surfactants are, for example, 1,4-sorbitan fatty acid esters of the formula

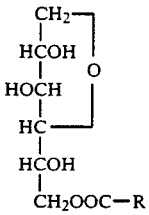

wherein R denotes alkyl having 11 to 17 C atoms;

fatty alcohol polyglycol ethers of the formula $$R-O(CH_2-CH_2-O)_nH$$

wherein n is 3 to 15 and R denotes straight-chain or branched alkyl having 9 to 19 C atoms; and alkylphenol polyglycol ethers of the formula

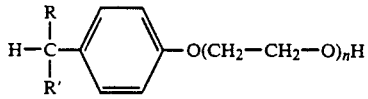

wherein n is 3 to 15 and R and R' denote alkyl having together 7 to 11 C atoms.

After storage or transportation has taken place, the liquid hydrocarbon must be recovered again, that is to say the gel structure must be broken down.

This is preferably effected by treatment with mechanical waves, by application of a reduced pressure or vacuum or, if the hydrocarbon-rich gel is formed with the aid of an ionic surfactant, by addition of an oppositely charged substance.

Mechanical waves are understood as meaning, in particular, high-frequency pressure waves, that is to say, for example, ultrasound. When the gel structure is broken down by ultrasound, the hydrocarbon phase already starts to emerge from the gel structure after only a few seconds. The separation has ended when two highly fluid phases are present side by side. This is as a rule the case after about 30 seconds.

If the gel structure is broken down by application of a reduced pressure or vacuum, the preferred range depends of course on the boiling point of the hydrocarbon. A vacuum of up to 0.1 torr is usually advantageous.

Oppositely charged surfactants or polymers or copolymers are preferably employed for breaking down gel structures formed with ionic surfactants.

In the case where gel structures based on cationic surfactants are broken down, the abovementioned anionic surfactants are particularly preferably employed.

Particularly preferred polymers having anionic groups are, for example, polyacrylates consisting of base elements of the formula

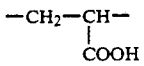

which can also be crosslinked and/or completely or partly neutralised;

poly-2-acylamido-2-methyl-propanesulphonic acids consisting of base elements of the formula

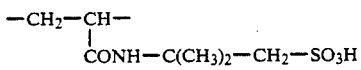

which can also be crosslinked and/or completely or partly neutralised;

or poly-vinylphosphonic acids consisting of base elements of the formula

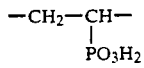

which can also be crosslinked and/or completely or partly neutralised.

Mixtures of the polymers mentioned or polymers which contain several of the base elements mentioned are also preferred. Polymers which consist, for example, of the above-mentioned base elements having a negative charge and those having a positive charge can also be employed.

Crosslinked, partly neutralised polyacrylic acid is especially preferred. This moreover has the advantage that, because of its enormous absorption capacity for water, it can bind quantitatively the aqueous phase of the gel to be broken down. Because of this absorption capacity for water, crosslinked, partly neutralised polyacrylic acid can break down not only gel structures based on cationic surfactants, but also those based on anionic, amphoteric or non-ionic surfactants.

The abovementioned cationic surfactants are particularly preferably employed in the case of breaking down gel structures based on anionic surfactants.

Particularly preferred polymers having cationic groups are, for example poly-diallyl-dimethylammonium chloride, which can also be cross-linked and/or completely or partly neutralised, or poly-methacrylic acid 2-dimethylaminoethyl ester, consisting of base elements of the formula

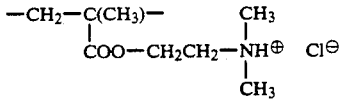

which can also be crosslinked and/or completely or partly neutralised.

Mixtures of the polymers mentioned or polymers which contain both the base elements mentioned are also preferred. Polymers which consist, for example, of the abovementioned base elements having a positive charge and those having a negative charge can also be employed.

The breaking down of the gel structure is carried out in a simple manner by adding the surfactant or polymer, as such or dissolved in a suitable solvent, to the gel structure and shaking the mixture briefly. The disintegration of the gel then starts spontaneously and is faster, the higher the counterion concentration. Appropriate gel disintegration rates are in fact achieved, depending on the system, if 0.2 to 25 g, preferably 0.4 to 5 g, of oppositely charged surfactant or polymer are added per g of surfactant contained in the gel.

Suitable solvents in which the surfactant or polymer employed for breakdown of the gel can be dissolved are, for example, xylene, water or alcohols.

The concentrations of the surfactants in the solvents are not critical, but are preferably from 30% by weight up to saturation of the solution. If the hydrocarbon to be stored or transported is a fuel or lubricating oil, it is particularly advantageous if surfactants which can remain in the hydrocarbon as an additive are chosen both for the gel formation and for the breakdown of the gel.

For example, sulphonates are known as detergent additives and alkenylsuccinic acid imidoamines are known as dispersant additives (J. Raddatz, W. S. Bartz, 5. Int. Koll. 14.-16.1.1986, Technische Akademie Esslingen "Additive für Schmierstoffe und Arbeitsflüssigkeiten [Additives for lubricants and working fluids]"). Succinimides are also known as oil and fuel additives (see, for example, EP 198 690, U.S. Pat. No. 4,614,603, EP 119 675, DE 3 814 601 or EP 295 789).

EXAMPLE 1 a) Preparation 1 g of sodium dodecyl-sulphate was dissolved in 9 g of water and the solution was initially introduced into a wide-necked conical flask. 400 g of ligroin were added at room temperature, while stirring vigorously by means of a magnetic stirrer. A hydrocarbon-rich gel system was formed by this procedure.

b) Pumping experiments

Pumping experiments were carried out with this gel system with the aid of an Ika tube pump. The diameter of the polyethylene tube used was 4 mm. The pumpability was recorded as the amount of gel pumped from vessel A to vessel B after a defined unit of time. The measurement results from a duration of the experiment of 5 minutes at different pumping speeds are summarised below:

| Speed level | Duration of experiment | Amount of gel pumped |
|---|---|---|
| 10 | 5 minutes | 3.8 g |
| 10 | 5 minutes | 3.7 g |

-continued

| Speed level | Duration of experiment | Amount of gel pumped |
|---|---|---|
| 20 | 5 minutes | 4.4 g |
| 20 | 5 minutes | 4.1 g |
| 20 | 5 minutes | 2.9 g |
| 20 | 5 minutes | 3.8 g |
| 20 | 5 minutes | 3.9 g |
| 20 | 5 minutes | 3.8 g |
| 30 | 5 minutes | 4.4 g |
| 30 | 5 minutes | 4.3 g |
| 30 | 5 minutes | 4.3 g |
| 30 | 5 minutes | 4.5 g |
| 40 | 5 minutes | 4.2 g |
| 40 | 5 minutes | 4.5 g |
| 40 | 5 minutes | 3.8 g |

Summarising, it can be said that, because of the visco-elasticity of the gel systems, the pump delivery proves to be independent of the pumping speed.

c) Storage and transportion

No changes in the consistency or rheological properties of the gel system were to be found over an observation period of six months. A permanent shear or a violent shaking movement during transportation by rail and road has no influence on the stability of the gel.

d) Breakdown of the gel by ultrasound

In a series of experiments, 50 g of gel each time having the composition described under 1a were broken down using the Sonifier Cell Disruptor B-30 ultrasound unit, different energy levels being set. The time of complete breakdown of the structure was recorded:

| Energy level | Time to breakdown |
|---|---|
| Level 10 | 1 second |
| Level 8 | 10 seconds |
| Level 6 | 35 seconds |
| Level 4 | 197 seconds |
| Level 3 | 390 seconds |

e) Breakdown of the gel by application of a vacuum 50 g of the gel prepared according to Example 1a in a 1 liter single-necked flask were connected to an oil pump via a vacuum regulator and cold trap. Under a vacuum of 0.6 mm Hg, disintegration of the gel started within 5 minutes when the flask was heated to a gel temperature of 30° to 40° C. by means of a thermostat bath, and had ended after a short time.

f) Breakdown of the gel by addition of a cationic surfactant 100 g of the gel prepared according to Example 1a were initially introduced into a 500 ml conical flask, and 600 ppm of a commercially available surfactant based on coconut-fatty amine were added. Disintegration of the gel took place spontaneously when the components were mixed thoroughly by simple mechanical agitation. A system of two highly fluid phases immiscible with one another resulted.

g) Breakdown of the gel by addition of a polymer having cationic groups 100 g of the gel prepared according to Example 1a were initially introduced into a 500 ml conical flask, and 4000 ppm of poly-diallyl-dimethyl-ammonium chloride were added. Disintegration of the gel took place spontaneously when the components were mixed thoroughly by simple mechanical agitation. A system of two highly fluid phases immiscible with one another resulted.

EXAMPLE 2

A hydrocarbon-rich gel of 1.6 g of sodium dodecylsulphate, 6.4 g of $H_2O$ and 392 g of kerosene was prepared as described in Example 1a, the components being mixed thoroughly with the aid of a Vortex Genie mixer.

Pumping experiments analogous to Example 1b gave the following results:

| Speed level | Duration of experiment | Amount of gel pumped |
|---|---|---|
| 10 | 5 minutes | 64.9 g |
| 10 | 5 minutes | 60.2 g |
| 10 | 5 minutes | 64.3 g |

The gel was broken down analogously to Examples 1d to 1g.

EXAMPLE 3

A hydrocarbon-rich gel of 1.6 g of a commercially available non-ionic surfactant based on a nonylphenol polyglycol ether, 6.4 g of $H_2O$ and 392 g of kerosene was prepared as described in Example 1a.

Pumping experiments analogous to Example 1b gave the following results:

| Speed level | Duration of experiment | Amount of gel pumped |
|---|---|---|
| 10 | 5 minutes | 55.4 g |
| 10 | 5 minutes | 58.5 g |
| 10 | 5 minutes | 54.4 g |

The gel was broken down analogously to Examples 1d and 1e.

EXAMPLE 4

A hydrocarbon-rich gel of 1.6 g of sodium dodecylsulphate, 6.4 g of $H_2O$ and 392 g of hexane was prepared as described in Example 1a.

Pumping experiments analogous to Example 1b gave the following results:

| Speed level | Duration of experiment | Amount of gel pumped |
|---|---|---|
| 10 | 5 minutes | 21.4 g |
| 10 | 5 minutes | 22.2 g |
| 10 | 5 minutes | 21.5 g |

The gel was broken down analogously to Examples 1d to 1g.

EXAMPLE 5

A hydrocarbon-rich gel of 1.6 g of a commercially available cationic surfactant based on a quaternary ammonium compound, 6.4 g of $H_2O$ and 392 g of kerosene was prepared as described in Example 1a.

Pumping experiments analogous to Example 1b gave the following results:

| Speed level | Duration of experiment | Amount of gel pumped |
|---|---|---|
| 10 | 5 minutes | 283.0 g |
| 10 | 5 minutes | 288.8 g |
| 10 | 5 minutes | 248.8 g |

The gel was broken down analogously to Examples 1d to 1g, but a crosslinked, partly neutralised polyacrylic acid was used in the case of 1g.

As described in Examples 1 to 5, hydrocarbon-rich from ligroin, anionic surfactant and water and in each case 41 g of these were broken down with the stated amount of cationic surfactant. The following cationic surfactants were used:

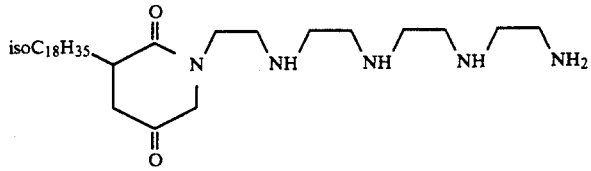

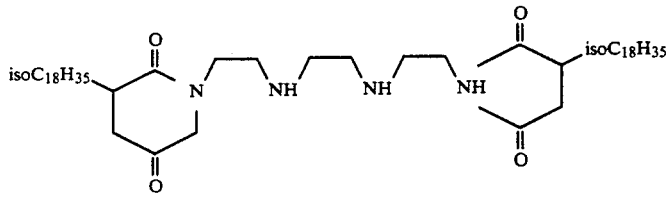

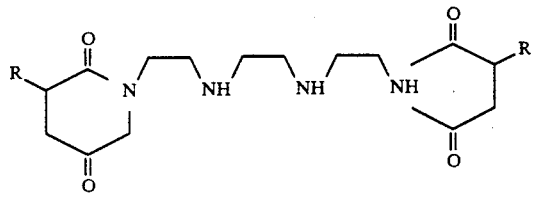

R = polybutenyl
molecular weight: 4653.3

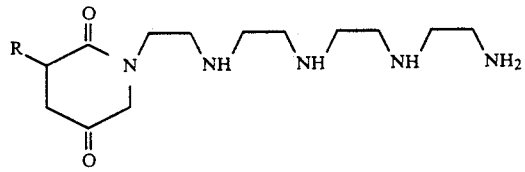

R = polybutenyl
molecular weight: 2421.3 gels of the following Examples 6 to 19 were prepared

| | | Gel composition in % by weight | | | | |
|---|---|---|---|---|---|---|
| Example | Anionic surfactant | Ligroin | Surfactant | Water | Cationic surfactant | Amount |
| 6 | commercially available Na alkylphenol ether-sulphate | 97.75 | 0.14 | 2.11 | 60% strength solution of A in xylene | 400 μl |
| 7 | $C_{12}H_{24}SO_4Na$ | 97.56 | 0.12 | 2.32 | 60% strength solution of A in xylene | 100 μl |
| 8 | $C_9H_{19}$—O—($CH_2$—$CH_2$—O)$_7SO_3Na$ | 95.89 | 0.13 | 3.98 | 60% strength solution of A in xylene | 400 μl |
| 9 | commercially available secondary Na alkane-sulphonate | 97.76 | 0.09 | 2.15 | 60% strength solution of A in xylene | 100 μl |
| 10 | commercially available secondary Na alkane-sulphonate | 98.87 | 0.09 | 1.04 | 60% strength solution of A in xylene | 100 μl |
| 11 | commercially available secondary Na alkane-sulphonate | 98.73 | 0.09 | 1.18 | 50% strength soltuion of C in xylene | 100 μl |
| 12 | $C_{12}H_{24}SO_4Na$ | 97.56 | 0.12 | 2.32 | 50% strength solution of C in xylene | 400 μl |
| 13 | commercially available Na alkylbenzenesulphonate | 96.53 | 0.11 | 3.36 | 50% strength solution of C in xylene | 200 μl |
| 14 | commercially available Na alkylbenzenesulphonate | 97.56 | 0.12 | 2.32 | 60% strength solution of B in xylene | 100 μl |
| 15 | commercially available Na alkylphenol ether-sulphate | 96.87 | 0.08 | 3.05 | 60% strength solution of B in xylene | 300 μl |
| 16 | commercially available Na $C_{12}/C_{14}$-alcohol ether-sulphate | 97.56 | 0.12 | 2.32 | 60% strength solution of B in xylene | 400 μl |
| 17 | octanephosphonic acid | 97.56 | 0.12 | 2.32 | 50% strength solution of D in xylene | 500 μl |
| 18 | commercially available triethanolamine $C_{12}/C_{14}$-alcohol-sulphate | 98.42 | 0.11 | 1.47 | commercially available stearyl-fatty amine | 59 mg |

-continued

| Example | Anionic surfactant | Gel composition in % by weight | | | Cationic surfactant | Amount |
|---|---|---|---|---|---|---|
| | | Ligroin | Surfactant | Water | | |
| 19 | $C_{12}H_{24}SO_4Na$ | 99.30 | 0.15 | 0.55 | commercially available dimethyl-fatty alkylamine | 53 mg |

As described in Examples 1 to 5, hydrocarbon-rich gels of the following Examples 20 to 36 were prepared from ligroin, cationic surfactant and water and in each case 1 g of these was broken down with the stated amount of anionic surfactant.

| Example | Cationic surfactant | Gel composition in % by weight | | | Anionic surfactant | Amount |
|---|---|---|---|---|---|---|
| | | Ligroin | Surfactant | Water | | |
| 20 | commercially available stearyl-fatty amine | 98.38 | 0.01 | 1.61 | commercially available Na lauryl alcohol ether-sulphate | 0.6 mg |
| 21 | commercially available stearyl-fatty amine | 98.36 | 0.11 | 1.53 | commercially available Na olefinesulphonate | 3.1 mg |
| 22 | commercially available dimethyl-fatty alkylamine | 96.49 | 0.11 | 3.62 | commercially available Na olefinesulphonate | 4 mg |
| 23 | commercially available coconut-fatty amine | 98.74 | 0.07 | 1.19 | commercially available triethanolamine $C_{12}/C_{14}$-alcohol-sulphate | 3.1 mg |
| 24 | distearyldimethylammonium chloride | 97.83 | 0.1 | 2.07 | commercially available Na $C_{12}/C_{14}$-alcohol ether-sulphate | 3.7 mg |
| 25. | distearyldimethylammonium chloride | 96.45 | 0.09 | 3.46 | commercially available alkanephosphonic acid | 3.7 mg |
| 26 | distearyldimethylammonium chloride | 99.28 | 0.09 | 0.63 | commercially available Na alkanesulphonate | 3.4 mg |
| 27 | commercially available dialkyldimethylammonium chloride | 99.2 | 0.07 | 0.73 | commercially available Na alkanesulphonate | 2.5 mg |
| 28 | commercially available dialkyldimethylammonium chloride | 97.56 | 0.08 | 2.36 | commercially available Na alkylphenol ether-sulphate | 4.2 mg |
| 29 | commercially available quaternary ammonium compound | 97.45 | 0.03 | 2.52 | $C_{12}H_{25}SO_4^{\ominus}Na^{\oplus}$ | 1.8 mg |

| Example | Surfactant | Gel composition in % by weight | | | Polymer | Amount |
|---|---|---|---|---|---|---|
| | | Ligroin | Surfactant | Water | | |
| 37 | $C_{12}H_{25}SO_4^{\ominus}Na^{\oplus}$ | 96.44 | 0.03 | 3.53 | 2 | 38 mg |
| 38 | " | 98.36 | 0.01 | 1.63 | 5 | 19 mg |
| 39 | " | 98.3 | 0.05 | 1.65 | 2 | 75 mg |
| 40 | " | 96.48 | 0.01 | 3.51 | 5 | 7 mg |
| 41 | $C_{15}H_{31}COO^{\ominus}Na^{\oplus}$ | 99.2 | 0.005 | 0.795 | 2 | 8 mg |
| 42 | $C_{11}H_{23}SO_4^{\ominus}Na^{\oplus}$ | 97.82 | 0.02 | 2.16 | 2 | 19 mg |
| 43 | $C_{11}H_{23}COO^{\ominus}Na^{\oplus}$ | 97.45 | 0.005 | 2.545 | 5 | 3.4 mg |
| 44 | $C_{12}H_{23}\overset{\oplus}{N}(CH_3)_3Br^{\ominus}$ | 97.4 | 0.07 | 2.53 | 1 | 47 mg |
| 45 | " | 99.34 | 0.08 | 0.58 | 1 | 83 mg |
| 46 | $C_{16}H_{33}\overset{\oplus}{N}(CH_3)_3Cl^{\ominus}$ | 95.9 | 0.05 | 4.05 | 3 | 54 mg |
| 47 | $C_{10}H_{21}\overset{\oplus}{N}(CH_3)_3Cl^{\ominus}$ | 98.74 | 0.08 | 1.18 | 1 | 95 mg |
| 48 | $(C_{16}H_{33})(C_2H_5)\overset{\oplus}{N}(CH_3)_2Br^{\ominus}$ | 97.32 | 0.01 | 3.51 | 3 | 9 mg |
| 49 | " | 98.32 | 0.09 | 1.59 | 4 | 74 mg |
| 50 | $C_{14}H_{29}\overset{\oplus}{N}(CH_3)_3Br^{\ominus}$ | 96.83 | 0.06 | 3.11 | 3 | 42 mg |

As described in Examples 1 to 5, hydrocarbon-rich gels of the following Examples 37 to 50 were prepared from ligroin, surfactant and water and in each case 1 g of these was broken down with the stated amount of an oppositely charged polymer.

The following polymers were employed:

Polymer 1: polyacrylate

Polymer 2: poly-dialkyl-dimethyl-ammonium chloride

Polymer 3: poly-2-acrylamido-2-methyl-propanesulphonic acid

Polymer 4: poly-vinylphosphonic acid

Polymer 5: poly-methacrylic acid 2-dimethylaminoethyl ester

| Example | Cationic surfactant | Gel composition in % by weight Ligroin | Surfactant | Water | Anionic surfactant | Amount |
|---|---|---|---|---|---|---|
| 30 | commercially available quaternary ammonium compound | 96.89 | 0.12 | 2.99 | $C_{12}H_{25}SO_4^{\ominus}Na^{\oplus}$ | 4.1 mg |
| 31 | commercially available quaternary ammonium compound | 96.83 | 0.15 | 3.02 | commercially available Na $C_{12}/C_{14}$-alcohol ether-sulphate | 6.8 mg |
| 32 | commercially available oleyl-fatty amine | 99.22 | 0.15 | 0.63 | commercially available Na alkylbenzene-sulphonate | 6.3 mg |
| 33 | commercially available tallow-fatty amine | 97.32 | 0.17 | 2.51 | $C_{12}H_{25}SO_4^{\ominus}Na^{\oplus}$ | 5.5 mg |
| 34 | distearyldimethylammonium chloride | 96.88 | 0.07 | 3.05 | " | 3.7 mg |
| 35 | commercially available lauryl-fatty amine | 97.4 | 0.07 | 2.53 | commercially available Na alkanesulphonate | 2.4 mg |
| 36 | commercially available coconut-fatty amine | 95.43 | 0.13 | 4.44 | commercially available Na alkanesulphonate | 6.5 mg |

It is claimed:

1. A process for the safe storage and the safe transportation of liquid hydrocarbons, comprising:

a) converting the hydrocarbon into a hydrocarbon-rich gel by addition of a surfactant and water and b) breaking down the hydrocarbon-rich gel after storage or transportation has taken place wherein said breaking down is accomplished by treatment with mechanical waves or application of a reduced pressure or vacuum or, when the hydrocarbon-rich gel is formed with the aid of an ionic surfactant, by addition of an oppositely charged surfactant, polymer or copolymer.

2. Process according to claim 1, wherein the surfactant and water are added to the hydrocarbon in amounts such that a hydrocarbon-rich gel of 70 to 99.5% by weight of hydrocarbon, 0.01 to 15% by weight of surfactant and 0.49 to 15% by weight of water is formed.

3. Process according to claim 2, wherein the surfactant and water are added to the hydrocarbon in amounts such that a hydrocarbon-rich gel of 80 to 99.5% by weight of hydrocarbon, 0.01 to 5% by weight of surfactant and 0.49 to 15% by weight of water is formed.

4. Process according to claim 3, wherein the hydrocarbon is selected from the group consisting of n-pentane, n-hexane, n-heptane, n-octane, n-nonane, n-decane, n-dodecane, n-tetradecane, n-hexadecane, cyclohexane, cyclooctane, benzene, toluene, kerosene, petrol, lead-free petrol, heating oil, diesel oil and crude oil.

5. Process according to claim 2, wherein the hydrocarbon is selected from the group consisting of n-pentane, n-hexane, n-heptane, n-octane, n-nonane, n-decane, n-dodecane, n-tetradecane, n-hexadecane, cyclohexane, cyclooctane, benzene, toluene, kerosene, petrol, lead-free petrol, heating oil, diesel oil and crude oil.

6. Process according to claim 5, wherein the surfactant is selected from the group consisting of anionic, cationic, amphoteric and non-ionic surfactants.

7. The process according to claim 6, wherein the anionic surfactants are selected from the group consisting of soaps, alkanesulphonates, alkylbenzenesulphonates, olefinsulphonates, fatty alcohol sulphates, fatty alcohol polygylcolsulphates, sulphossuccinates, fatty alcohol polyglycol phosphates, alkane phosphonates and sodium salts of oleic acids or mixtures thereof.

8. The process as claimed in claim 7, wherein the anionic surfactants are selected from the group consisting of a) soaps of the formula $R—CH_2—COO^{\ominus}Na^{\oplus}$ wherein R denotes a hydrocarbon radical having 10 to 20 carbon atoms;

b) alkanesulphonates of the formula

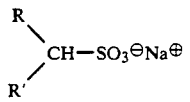

wherein R and R′ denote alkyl radicals having together 11 to 17 carbon atoms;

c) alkylbenzenesulphoantes and -sulfates of the formula

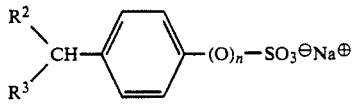

wherein n is 0 or 1 and $R^2$ and $R^3$ denote alkyl radicals having together 11 to 13 carbon atoms;

d) olfinesulphonates of the formula $R^4—CH_2—CH{=}CH—CH_2—SO_3^{\ominus}Na^{\oplus}$ wherein $R^4$ denotes alkyl having 10 to 14 carbon atoms;

e) fatty alcohol sulphates of the formula $R^5—CH_2—O—SO_3^{\ominus}Y^{\oplus}$ wherein $R^5$ denotes alkyl having 11 to 15 carbon atoms and $Y^{\oplus}$ denotes $Na^{\oplus}$ or triethanolamine;

f) fatty alcohol polyglycol sulphates of the formula $R^6—CH_2—O(C_2H_4O)_n—SO_3^{\ominus}Na^{\oplus}$ wherein n is 2 to 7 and $R^6$ denotes alkyl having 8 to 15 carbon atoms;

g) sulphosuccinates of the formula

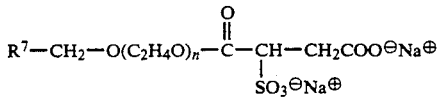

wherein n is 2 to 6 and $R^7$ denotes alkyl having 11 to 13 carbon atoms;

h) fatty alcohol polyglycol phosphates of the formula $R^8—CH_2—O(C_2H_4O)_nPO_3H^{\ominus}Na^{\oplus}$ wherein n is 2 to 6 and $R^8$ denotes alkyl having 15 to 17 carbon atoms;

i) alkanephosphonates of the formula $R^9—PO_3H^{\ominus}Na^{\ominus}$ wherein $R^9$ denotes alkyl having 12 to 16 carbon atoms; and j) sodium salts of oleic acid sarcoside, oleic acid isothionate or oleic acid methyl-tauride.

9. The process as claimed in claim 6, wherein the cationic surfactants are selected from the group consisting of quaternary ammonium compounds, fatty amines, ammonium borate betaine, stearyl-N-acylamido-N-methyl-imidazolinium chlorides and alkenylsuccinic acids or mixtures thereof.

10. The process as claimed in claim 9, wherein the cationic surfactants are selected from the group consisting of a) quaternary ammonium compounds of the formula

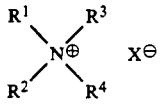

wherein $R^1$ denotes alkyl having 10 to 22 carbon atoms, $R^2$ denotes alkyl having 1 to 12 carbon atoms or benzyl, $R^3$ and $R^4$ independently of one another denote hydrogen or methyl and $X^\ominus$ denotes $Cl^\ominus$, $Br^\ominus$ or $CH_3SO_4^\ominus$;

b) fatty amines which are selected from the group consisting of coconut-fatty amines, lauryl-fatty amine, oleyl-fatty amine, stearyl-fatty amine, tallow-fatty amine, dimethyl-fatty amines and primary alkylamines having pure chains of 8 to 22 carbon atoms;

c) ammonium borate betaine based on didecylamine;

d) stearyl-N-acylamido-N-methyl-imidazolinium chlorides of the formula

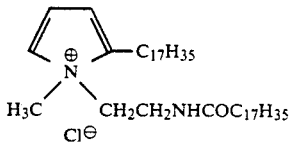

and e) alkenylsuccinic acid derivatives of the formula

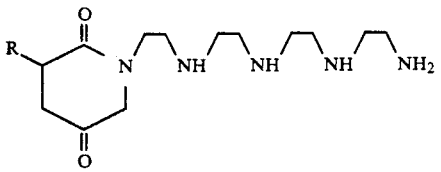

or

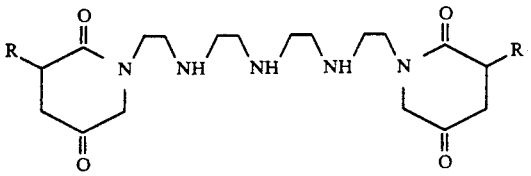

wherein R in each case denotes iso-$C_{18}H_{35}$ or polybutyenyl.

11. The process as claimed in claim 6, wherein the amphoteric surfactants are selected from the group consisting of alkyl betaines; N-carboxyethyl-N-alkylamido-ethylglyciantes and N-alkylamido-propyl-N-dimethylamine oxides or mixtures thereof.

12. The process as claimed in claim 11, wherein the amphoteric surfactants are a) alkylbetaines of the formula

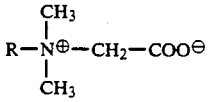

wherein R denotes alkyl having 12 to 14 carbon atoms;

b) N-carboxyethyl-N-alkylamido-ethylglycinates of the formula

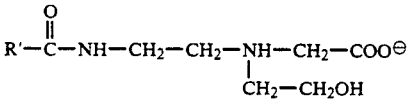

wherein R′ denotes alkyl having 11 to 13 carbon atoms; and c) N-alkylamido-propyl-N-dimethylamine oxides of the formula

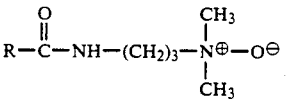

wherein R denotes alkyl having 11 to 13 carbon atoms.

13. The process according to claim 6, wherein the nonionic surfactants are selected from the group consisting of 1,4-sorbitan fatty acid esters, fatty alcohol polyglycol ethers and alkylphenyl polyglycol ethers or mixtures thereof.

14. The process according to claim 13, wherein the nonionic surfactants are selected from the formula a) 1,4-sorbitan fatty acid esters of the formula

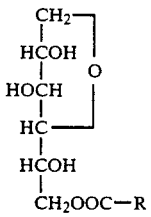

wherein R denotes alkyl having 11 to 17 carbon atoms;

b) fatty alcohol polyglycol ethers of the formula $$R—O(CH_2—CH_2—O)_nH$$

wherein n is 3 to 15 and R denotes straight-chain or branched alkyl having 9 to 19 carbon atoms; and c) alkylphenyl polyglycol ethers of the formula

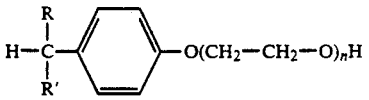

wherein n is 3 to 15 and R and R′ denote alkyl having together 7 to 11 carbon atoms.

15. Process according to claim 1, wherein the surfactant and water are added to the hydrocarbon in amounts such that a hydrocarbon-rich gel of 80 to 99.5% by weight of hydrocarbon, 0.01 to 5% by weight of surfactant and 0.49 to 15% by weight of water is formed.

16. Process according to claim 15, wherein the surfactant is selected from the group consisting of anionic, cationic, amphoteric and non-ionic surfactants.

17. Process according to claim 1, wherein the hydrocarbon is selected from the group consisting of n-pentane, n-hexane, n-heptane, n-octane, n-nonane, n-decane, n-dodecane, n-tetradecane, n-hexadecane, cyclohexane, cyclooctane, benzene, toluene, kerosene, petrol, lead-free petrol, heating oil, diesel oil and crude oil.

18. Process according to claim 1, wherein the surfactant is selected from the group consisting of anionic, cationic, amphoteric and non-ionic surfactants.

19. Process according to claim 1, wherein the hydrocarbon-rich gel is formed with the aid of ionic surfactants and is broken down by adding oppositely charged surfactants or polymers or copolymers to the hydrocarbon-rich gel.

20. The process as claimed in claim 1, wherein the mechanical waves are high frequency pressure waves.

* * * * *